US010189073B2

(12) United States Patent
Dubugnon

(10) Patent No.: US 10,189,073 B2
(45) Date of Patent: Jan. 29, 2019

(54) MATRIX FOR MAKING CLINCH-TYPE JOINTS BETWEEN SHEET-FORMED MEMBERS AND AN APPARATUS INCLUDING SUCH A MATRIX

(71) Applicant: ATTEXOR CLINCH SYSTEMS S.A., Ecublens (CH)

(72) Inventor: Olivier Dubugnon, Vullierens (CH)

(73) Assignee: BOLLHOFF ATTEXOR S.A., Ecublens (CH)

( * ) Notice: Subject to any disclaimer, the term of this patent is extended or adjusted under 35 U.S.C. 154(b) by 548 days.

(21) Appl. No.: 14/770,531

(22) PCT Filed: Feb. 25, 2014

(86) PCT No.: PCT/EP2014/053640
§ 371 (c)(1),
(2) Date: Aug. 26, 2015

(87) PCT Pub. No.: WO2014/131761
PCT Pub. Date: Sep. 4, 2014

(65) Prior Publication Data

US 2016/0016221 A1 Jan. 21, 2016

(30) Foreign Application Priority Data

Feb. 28, 2013 (SE) ..... 1350241

(51) Int. Cl.
*B21D 39/03* (2006.01)

(52) U.S. Cl.
CPC ..... *B21D 39/031* (2013.01)

(58) Field of Classification Search
CPC ..... B21D 39/031; B23P 11/00; B23P 11/005; B23P 11/025; B23P 11/027; B23B 13/00
See application file for complete search history.

(56) References Cited

U.S. PATENT DOCUMENTS 5,267,383 A * 12/1993 Sawdon ..... B21D 39/031 29/243.5
2010/0212131 A1* 8/2010 Sawdon ..... B21D 39/031 29/243.5

FOREIGN PATENT DOCUMENTS

| | | |
|---|---|---|
| CN | 1775407 | 5/2006 |
| DE | 10 2004 038922 | 2/2006 |
| JP | S62 148035 | 7/1987 |

OTHER PUBLICATIONS

Office Action issued in Chinese Patent Application No. 201480024183.9, dated May 2, 2017, pp. 1-6.

(Continued)

*Primary Examiner* — David Bryant
*Assistant Examiner* — Nirvana Deonauth
(74) *Attorney, Agent, or Firm* — Jeffrey S. Melcher; Manelli Selter Pllc

(57) ABSTRACT

A matrix for making clinch-type joints between at least two members of sheet-formed material of the same or different types. Said matrix (1) has the form of a thin plate, and comprises two generally flat sheet-formed matrix elements (2, 3, 2', 3', 102, 103) arranged movable relative to each other so that they could slide on an essentially flat support surface (31, 34, 134) in a substantially translational or pivotal movement between a first initial position in which said matrix elements (2, 3, 2', 3', 102, 103) form between them at least one essentially closed matrix cavity (23, 23', 123) and a second position corresponding to an open position for said at least one matrix cavity, said matrix elements (2, 3, 2', 3', 102, 103) being arranged actuated in the direction of said first position by at least one actuation means (4, 10, 104). An apparatus including such a matrix is also proposed.

18 Claims, 4 Drawing Sheets

(56) References Cited

OTHER PUBLICATIONS

Translation of first two pages of Office Action issued in Chinese Patent Application No. 201480024183.9, dated May 2, 2017, pp. 1-3.
International Search Report issued in PCT/EP2014/053640, dated Apr. 22, 2014, pp. 1-3.
Office Action issued in Chinese Patent Application No. 201480024183.9, dated Aug. 31, 2016, pp. 1-6.
Translation of first two pages of Office Action issued in Chinese Patent Application No. 201480024183.9, dated Aug. 31, 2016, pp. 1-3.
Office Action issued in Chinese Patent Application No. 201480024183.9, dated Nov. 24, 2017, pp. 1-6.

* cited by examiner 101
105
104
104
103
102
123

105
114
134
116

105
103
102
123
136
135
135
136
C
C

12"
14"
1
13"
1

MATRIX FOR MAKING CLINCH-TYPE JOINTS BETWEEN SHEET-FORMED MEMBERS AND AN APPARATUS INCLUDING SUCH A MATRIX

TECHNICAL FIELD

The present invention refers to a matrix for making clinch-type joints between at least two members of sheet-formed material of the same or different types, metal or non-metal. By means of a co-operating punch and such a matrix and an anvil the members are joined together by drawing the material in the sheets forming a cavity in said sheets and then laterally extending the bottom part of said cavity by means of squeezing the material between the punch and the anvil to lock the members to each other. This joining technique is well known in the art under the name clinching.

More specifically the invention refers to a new type of matrix which on one hand has the form of a thin plate and therefore is well suited for tools for work in narrow environments and on the other hand is also well suited for configuration as a multiple matrix, i.e. comprising multiple matrix cavities. The multiple matrix design will make it possible to simultaneously make several clinch-type joints between work-pieces. The invention also refers to an apparatus for making joints of said type including a matrix according to the invention.

The apparatuses or machines according to the invention could be of stationary or hand-held type and the power source could e.g. be electric, hydraulic or pneumatic.

BACKGROUND ART

The technique as such for making separate joints of this type is well known in the art. A suitable tool comprises generally two separate tool-parts which co-operate for producing said joint. A first tool-part has the form of a punch which in an essentially linear stroke is driven in the direction of a co-axial second tool-part in the form of a matrix with a matrix cavity at the bottom of which an anvil is arranged.

For making the joint the sheet-formed members are positioned against the second tool-part, the matrix, provided with movable matrix elements, in certain embodiments arranged sliding laterally on a support surface against the forces from a spring element. The spring element is generally constituted by a ring made of an elastomer or a toroid formed metal spring surrounding the movable matrix elements.

The approaching punch impacts on the surface of one of the members to be joined. The material of the two members is first drawn into the matrix cavity and subsequently due to the interaction between the punch and the anvil at the bottom of the cavity laterally extruded, thereby displacing the movable matrix elements outwardly creating in the sheet-formed members a mushroom formed button which interlocks the members. The dimension of known matrixes in the direction of the essentially linear stroke or movement of the co-operating punch, i.e. perpendicular to the plane of the sheet-formed members to be joined is typically many times the diameter of the matrix cavity.

BRIEF DESCRIPTION OF THE INVENTION

One object of the present invention is to provide a matrix which has the form of a plate, i.e. a flat, thin piece of material, preferably metal, thus small vertical dimensions and therefore is well suited for tools for work in narrow environments. The dimension of the matrix according to the invention in the direction of the essentially linear stroke or movement of the co-operating punch could be made in the order of the diameter of the closed matrix cavity or even smaller.

As will be described the matrix according to the invention is also well suited for configuration as a multiple matrix, i.e. comprising multiple matrix cavities.

A further object of the invention is to provide a multiple matrix making it possible to realise multiple joints between sheet-formed members where the joints are positioned very close to each other in practically unlimited configurations.

Additionally the matrix according to the invention, designed with one or several matrix cavities, is very robust and wear resistant and on top of that very simple and cheap to manufacture.

A still further object of the invention is to provide an apparatus provided with a matrix according to the invention having one or several matrix cavities. Such an apparatus can be designed with dimensions making it suitable for operation in very narrow spaces.

An apparatus according to the invention could be designed for simultaneously making multiple joints between two or several sheet-formed members. To this end the apparatus is making use of multiple punch elements and a multiple matrix comprising a first and a second matrix element movable relative to each other in e.g. a substantially translational or pivoting movement.

An apparatus according to the invention could even be configured in order to simultaneously make multiple joints on two or several distinct separated planes on the same or different work-piece(s).

The present invention, which provides a solution to the said technical problems, is characterized according to the appended claims.

BRIEF DESCRIPTION OF THE FIGURES

In order to clearly illustrate the versatility of the matrix and apparatus according to the invention the following drawings and corresponding parts of the specification are all showing and describing multiple matrixes and apparatuses provided with such matrixes.

The man skilled in the art will, however, easily understand how the corresponding matrixes with only one matrix cavity and apparatuses provided with such matrixes could be designed.

Figure 1:
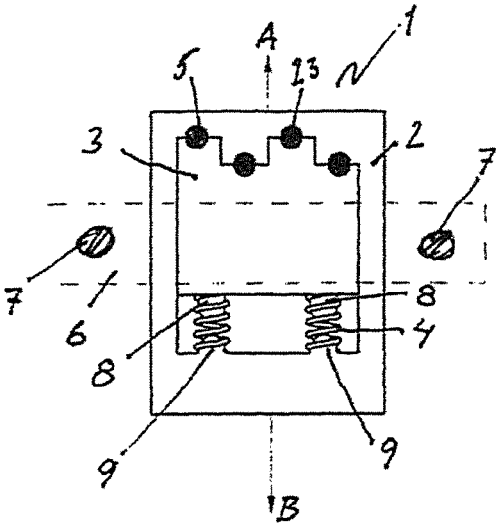
Figure 2:
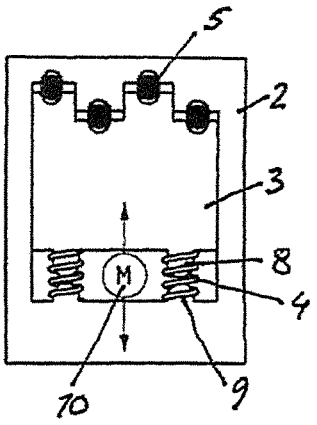
Figure 3:
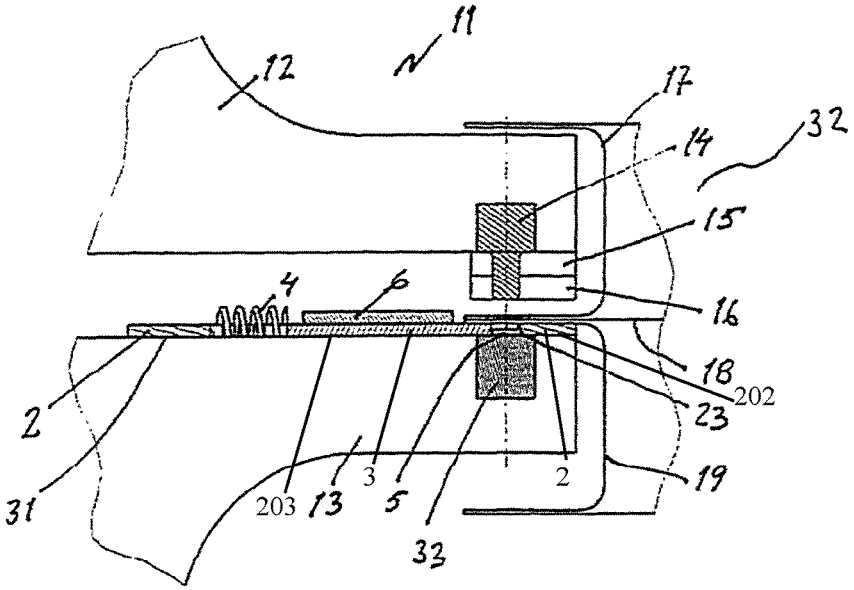

Other objects, uses and advantages of this invention will be apparent from the reading of this description which proceeds with reference to the accompanying drawings forming part thereof and wherein:

FIG. 1 schematically shows a top view of a first embodiment of a matrix according to the invention provided with four cavities in closed position, FIG. 2 schematically shows a top view of the embodiment according to FIG. 1 with the matrix cavities in open position, FIG. 3 schematically shows a side view of part of an apparatus, partly in section, according to the invention provided with a multiple matrix, in a position ready to make a joint on a work-piece.

Figure 4:
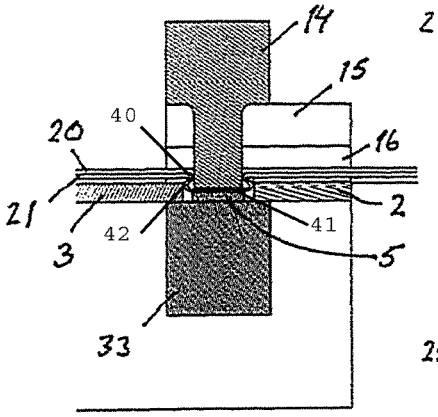
Figure 5:
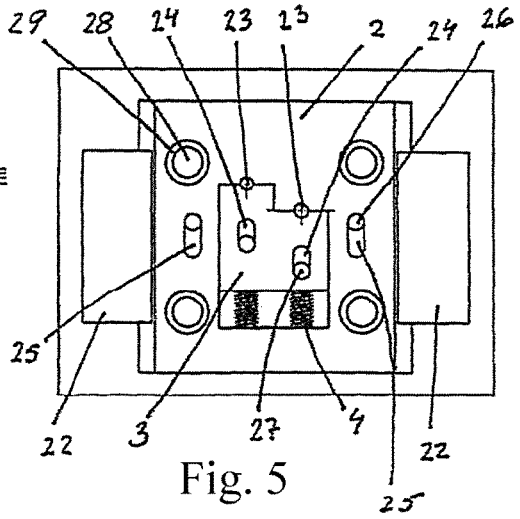
Figure 6:
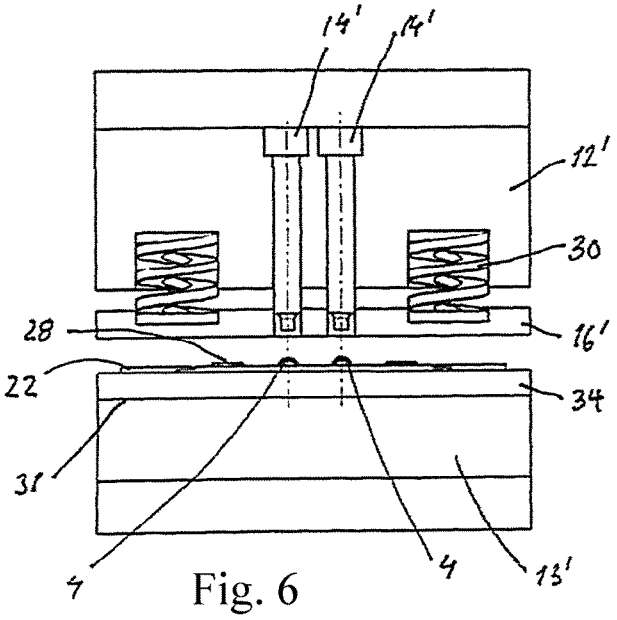
Figure 7:
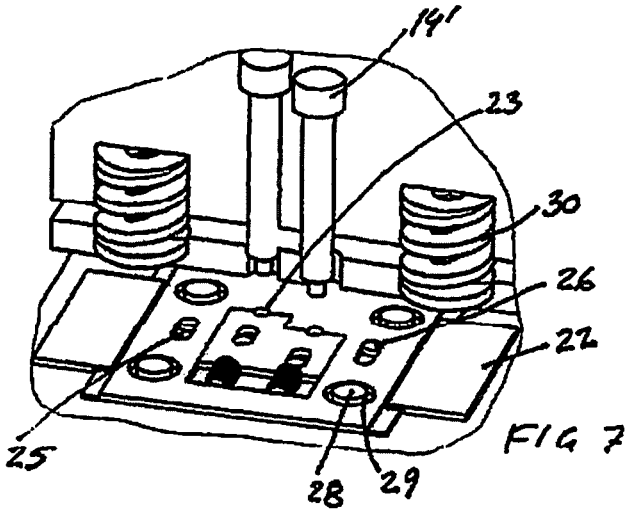
Figure 8:
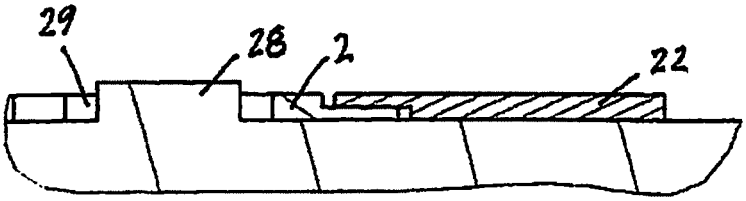
Figure 9:
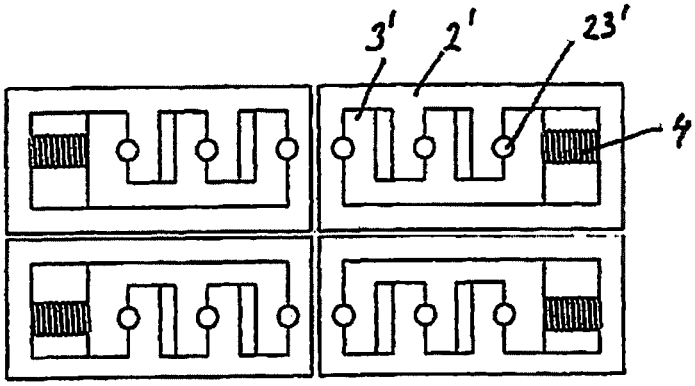

FIG. 4 schematically shows, in section, a collaborating punch, matrix and anvil in an apparatus which together have created a joint between two sheet-formed members, FIG. 5 schematically shows more in detail how a second embodiment of a multiple matrix according to the invention could be fixed and guided in an apparatus according to the invention, FIG. 6 schematically shows the front end of an apparatus according to the invention, partly in section, with a multiple matrix according to FIG. 5 with two matrix cavities, two co-operating punches and a stripper plate, FIG. 7 shows in a perspective view the arrangement according to FIG. 6, FIG. 8 shows a detail of one embodiment of the means for mounting a matrix in the apparatus according to the invention, FIG. 9 schematically shows four separate third embodiments of a multiple matrix each provided with three matrix cavities which can be operated simultaneously in an apparatus according to the invention.

Figures 10, 11A, 11B, 11C, 11D:
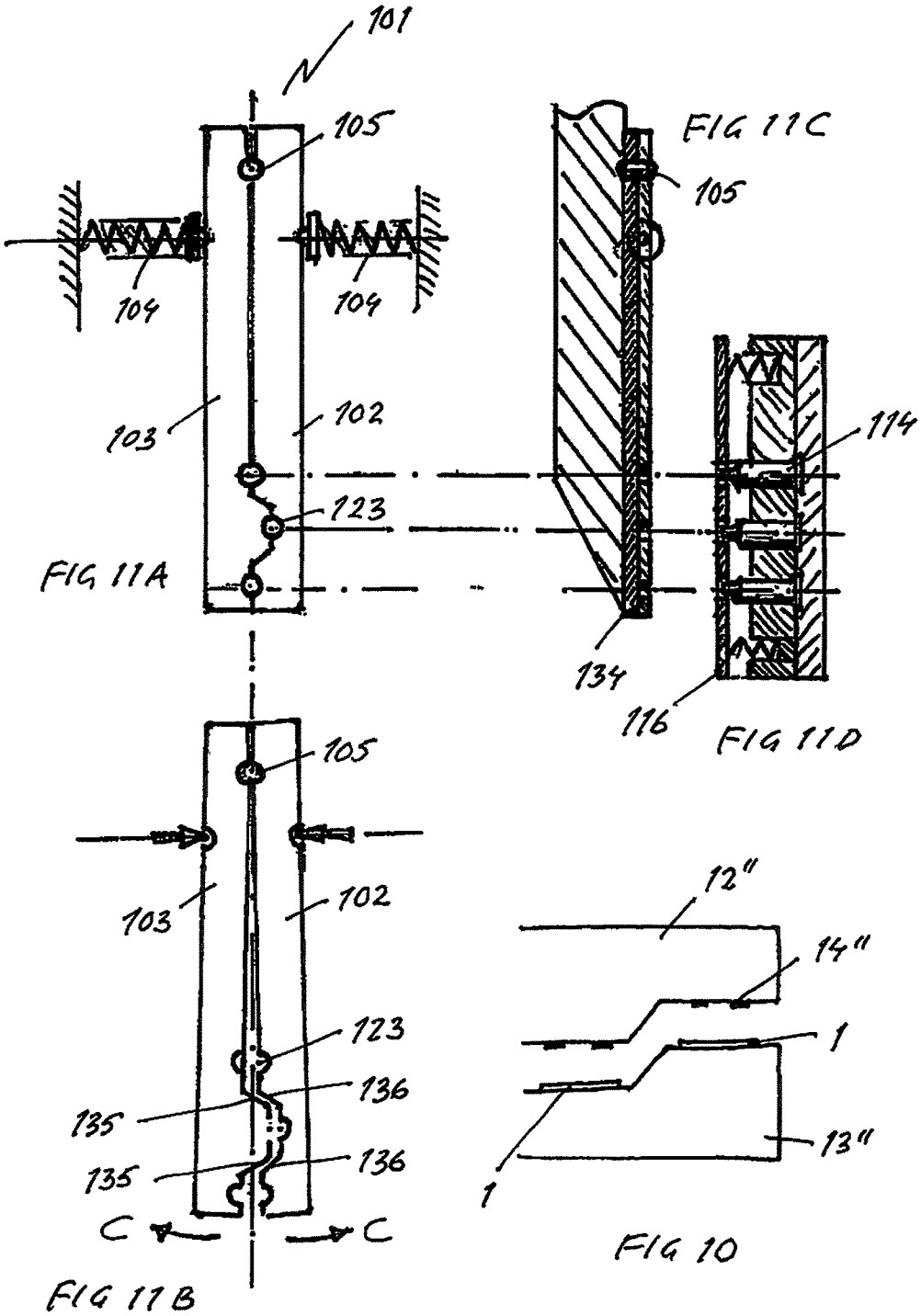

FIG. 10 schematically shows a side view of part of an apparatus according to the invention presenting two distinct levels or steps on a respective upper and lower tool-carrying member or jaw, the lower jaw being provided with a multiple matrix according to the invention at each level.

FIG. 11 A-D schematically shows a matrix provided with three matrix cavities and details of its arrangement in an apparatus.

DETAILED DESCRIPTION OF THE INVENTION

FIG. 1 schematically shows an embodiment of a multiple matrix 1 according to the present invention. The multiple matrix 1 comprises two essentially flat matrix elements 2, 3 arranged movable relative to each other forming between them four matrix cavities 23. In FIG. 1 the multiple matrix is shown with the matrix cavities 23 in closed position which is the position at the start of the procedure when the sheet-formed members are positioned on top of the matrix, cf. e.g. sheets 17, 18, 19 in FIG. 3, before the impact of the corresponding punch elements 14, cf. FIG. 3, 4.

When mounted on an essentially flat support surface in an apparatus according to the invention, cf. e.g. FIG. 3, the matrix elements 2, 3 are arranged in such a way that they are also independently movable relative to said flat support surface 31 essentially along an axis A-B in two opposite directions. Each of the flat matrix elements 2, 3 have an associated flat element surface 202, 203 that slides on the flat support surface 31, i.e. the flat matrix elements 2, 3 slide on a same plane.

For mounting the multiple matrix 1 on the essentially flat support surface and blocking vertical movement of the matrix elements 2, 3 a simple clamping element 6, in the form of a bridge fixed by two screws, could be used, cf. also FIG. 3. It is, however, essential that the arrangement is giving enough freedom for the reciprocating movement of the sliding matrix elements 2, 3 on the support surface. Another way of mounting the matrix elements will be described with reference to FIG. 5-8.

FIGS. 1 and 2 shows an arrangement of the separate matrix cavities in which arrangement adjacent cavities are laterally displaced in relation to each other. This is also the case in FIGS. 5 and 7 which gives the configuration of the cavities a meander-form in this embodiment.

It is, however, understood that depending on the application the number of separate matrix cavities and their arrangement could be freely chosen. The simplest form is of course a matrix with only one matrix cavity. A simple configuration for a multiple matrix would be an arrangement of the cavities in a straight row. Such a configuration is e.g. shown in FIG. 9.

In the embodiments illustrated in the FIG. 1-9 the matrix element 2, 2' has been given the form of a frame enclosing the matrix element 3, 3' so that the element 3', 3' will be guided in its movement relative to the element 2, 2' by means of two parallel opposite parts of the frame. This gives a particular compact and practical design of the matrix 1. Other configurations could of course be envisaged. The two matrix elements could e.g. be guided separately in their relative movement approaching each other from opposite directions when forming the matrix cavities.

The separate matrix cavity 23 could in the starting or rest position, i.e. before the impact by the corresponding punch element 14 be circular, oval or have any other suitable form.

All the matrix cavities 23 in the same configuration could have the same size and form in the rest position or different separate matrix cavities 23 could have different sizes and forms.

As in the prior art apparatuses for making single joints it is essential that the first and second tool-parts, i.e. the punch and the matrix, are aligned before the stroke. As will be described more in detail with reference to FIG. 3-7 the first and second tool-parts could be arranged on an upper and a lower tool-carrying member or jaw respectively forming part of an apparatus according to the invention. In the following "tool-carrying member" and "jaw" will be used designating the same part of an apparatus according to the invention. For the formation of the joints these jaws with their respective tool-parts are driven in an essentially linear movement towards each other. The designations "upper" and "lower" are here used for the description with reference to the drawings and are in reality irrelevant as the apparatus of course will work irrespective of the actual orientation in space.

In a first embodiment of such an apparatus 11, as illustrated in FIG. 3, there are for each position corresponding to the configuration of separate matrix cavities 23 on the multiple matrix 1, a punch element 14 and a corresponding anvil element 33 arranged aligned in the upper and lower jaws 12, 13 respectively.

The lower jaw 13 is provided with an upper essentially flat support surface 31. A tip 5 of each anvil element is protruding vertically from said surface. Thus, according to this embodiment the active part of the respective anvil, i.e. the tip 5, has a fixed position on the support surface 31.

The tip 5 of each anvil element 33 is preferably cylindrical with a section essentially corresponding to the form of the matrix cavity 23 in the corresponding position. In the illustrated embodiments of the multiple matrix 1 all the matrix cavities 23 have the same size and form, i.e. circular-cylindrical, for simplifying the description, but as mentioned above individual cavities 23 or all cavities of the multiple matrix 1 could have different sizes and forms.

The essentially flat multiple matrix 1 is positioned on the upper support surface 31 of the lower jaw 13 with a corresponding tip of an anvil element 33 reaching from below into the respective matrix cavity 23 in its rest position, cf. FIG. 3. By means of this arrangement the respective punch element 14 will be perfectly aligned with a corresponding matrix cavity 23 and tip 5 of an anvil element 33. In FIGS. 1 and 2 the tip 5 of the anvil element 33 is shown as a black spot at the bottom of the respective matrix cavity 23.

As mentioned above the matrix elements 2, 3 are movable relative to each other and independently movable relative to said support surface 31 in two opposite directions essentially along an axis illustrated by the arrows A-B, cf. FIG. 1. In this embodiment the movements are controlled by means of two spring elements 4 arranged between the matrix elements 2, 3 biasing the one against the other. In the free space between the matrix elements 2, 3 inside the frame defined by the matrix element 2 two pairs of opposite fixing elements 8, 9 for the end portions of the two spring elements 4 are arranged. These fixing elements could also be designed by means of their respective length to limit the opening of the matrix cavities which could be of advantage in the formation of the joint. It should be clear that one single spring element could also have the same function as illustrated in e.g. FIG. 9. Another configuration could be to have one spring element or the like pulling the element 2 in the direction B and another spring element pushing the element 3 in the direction A, cf. e.g. FIG. 1. The main thing is that the forces from the spring elements are closing the matrix cavities 23 around the protruding parts 5 of the anvil elements 33 thereby positioning the multiple matrix 1 at the start of the joint forming procedure.

Instead of one or several spring elements other actuation means could be envisaged. In FIG. 2 an actuation means 10 is shown schematically between the matrix elements 2, 3 which can replace or complement the spring elements. The illustration indicates only the action on the two matrix elements not necessarily the physical position of the actuation means which e.g. could be an electrical motor, a pneumatic or hydraulic cylinder-piston assembly or the like.

FIG. 2 schematically shows the first embodiment of the multiple matrix 1 in open position at the end of the joint forming procedure. The two matrix elements 2, 3 have been displaced in relation to each other and also in relation to the fixed protruding portions 5 of the anvil elements 33 illustrated as black dots. The lateral flow of material due to compression of the work piece against the forces from the spring elements causes these displacements. FIG. 4 also illustrates this position. FIG. 4 shows a formed clinch joint having the cup-formed protrusion 40, bottom part 41, and side walls 42.

FIG. 3 schematically shows a side view of part of an apparatus 11, partly in section, according to the invention provided with a matrix 1, in a position ready to simultaneously make a number of joints on a work piece 32. The punch elements 14, of which only one is shown in the drawing, are mounted in the upper jaw 12 with a protruding portion reaching in the direction of a respective corresponding matrix cavity 23. This protruding portion is surrounded, with some play, by an elastic element 15 of e.g. a suitable elastomer and a stripper plate 16 which e.g. could be made of metal, and which plate 16 is clamping the work-piece 32 against the multiple matrix 1 when the jaws are approaching each other during the joint forming process. The clamping element 6 holding the multiple matrix 1 down against the support surface 31 as described above is also schematically shown.

In the illustrated example of application the apparatus is positioned for simultaneously making a number of joints between three metal sheets 17, 18, 19 forming a flange on the work-piece 32. The particular design of the apparatus makes it possible to work in very narrow spaces (the order of 10 mm) and very close to edges.

FIG. 4 schematically shows, in section, a collaborating punch element 14, matrix 2, 3 and anvil 33, 5 which together have created a joint between two sheet-formed members 20, 21 when the upper and lower jaws have been approached to each other. The lateral expansion of the joint has displaced the matrix elements 2, 3 as in FIG. 2.

FIG. 5 schematically shows more in detail another way of mounting and guiding a matrix in an apparatus according to the invention. The matrix is here exemplified with only two matrix cavities 23 with circular section for simplifying the drawing and description. As before other numbers, shapes of the cavities and configurations are of course possible.

This embodiment of the multiple matrix and apparatus has the advantage that no separate anvils are necessary, neither for the expansion of the joints nor for the positioning of the matrix before the stroke. The upper surface 31 of the lower jaw 13', cf. FIG. 6, is in this embodiment provided with an exchangeable wear plate 34 to make the apparatus more wear resistant and to work as mounting plate for two side-clamping elements 22 and a number if pins 26, 27 for positioning and limiting the movement of the multiple matrix.

As in the first embodiment described above the matrix comprises two essentially flat matrix elements 2, 3 arranged movable relative to each other forming between them two matrix cavities 23, here shown in closed position. The matrix elements are also independently movable relative to said wear plate 34 essentially in the vertical direction in the figure. For mounting the multiple matrix on the wear plate 34 and blocking vertical movement of the matrix elements 2, 3 two side-clamping elements 22 are arranged along two opposite sides of the matrix element 2, cf. also FIGS. 7 and 8. As before the arrangement is giving enough freedom for the reciprocating movement of the sliding matrix elements 2, 3 on the wear plate 34.

The actuation means are shown as spring elements 4 as in the FIG. 1-3, but can as mentioned above be replaced by other actuation means. Moreover one spring element would be enough for the function. The spring elements apply a force upwards in the figure on the matrix element 3 and downwards on the matrix element 2 which in reality correspond to lateral forces on the matrix elements positioned on top of the wear plate 34. At least one pin 26, 27 per matrix element is fixed in the wear plate 34 and positioned in a respective oblong hole 25, 24 arranged in the respective matrix element 2, 3 parallel to the axis of their movement. These pins and corresponding holes are arranged to limit the movements of the matrix in relation to the wear plate.

In the figure the pin 26 bears against the upper end portion of the oblong hole 25 in the matrix element 2, thereby defining the lowest vertical position of that matrix element in the figure. At the same time the pin 27 bears against the lower end portion of the oblong hole 24 in the matrix element 3, thereby defining the highest vertical position of that matrix element in the figure. This position corresponds to a predefined position of the closed matrix cavities 23 on the wear plate 34 aligned with two punch elements 14' in the upper jaw 12', cf. FIG. 6.

Additionally four distance bolts 28 are fixed on the wear plate and reach through holes 29 in the matrix element 2 giving enough play for the lateral movement of the multiple matrix. These bolts are reaching somewhat higher than the top level of the mounted matrix as shown in e.g. FIG. 6, thereby giving enough freedom for the reciprocating movement of the sliding matrix elements 2, 3 on the wear plate when the stripper plate 16' during the process is pressing the sheet-formed members to be joined against the matrix.

Another way of guiding, limiting the lateral movement of and blocking the vertical movement of the matrix elements 2, 3 could be implemented by means of replacing the pins 26, 27 by means of e.g. screws with countersunk heads in countersunk oblong holes. This would also eliminate the need of the clamping elements 22.

FIG. 6 schematically shows the front end of an apparatus according to the invention, partly in section, with a multiple matrix with two matrix cavities, two co-operating punches 14' and a stripper plate 16'. The elastic elements for the stripper plate are here shown as spring elements 30. The multiple matrix is of the type described with reference to FIG. 5.

FIG. 7 shows in a perspective view the arrangement according to FIG. 6.

FIG. 8 shows a detail of one embodiment of the means for mounting the multiple matrix in the apparatus according to the invention as described with reference to FIG. 5.

FIG. 9 schematically shows a group of four separate third embodiments of the multiple matrix which can be operated simultaneously in an apparatus according to the invention. As in the embodiments described above a first matrix element 2' has the form of a frame within which a second matrix element 3' will be guided in its movement relative to the first element 2' by means of two parallel opposite parts of the frame. The two matrix elements have each the form of a comb with their respective pins intervening. The matrix cavities 23' are formed between two adjacent pins, one on each comb. In this case a single spring elements 4 is arranged between the matrix elements 2', 3' biasing the one against the other. The forces from the spring elements 4 are closing the matrix cavities 23' around the protruding parts of the anvil elements (not shown in this figure) thereby positioning the multiple matrix at the start of the joint forming procedure like in the embodiment described with reference to FIG. 1. The necessary clamping element for mounting each multiple matrix on a suitable support surface is not shown in the figure.

The configuration of the matrix cavities for the separate matrix is here a straight line with three cavities 23'. The overall arrangement gives two lines with each six cavities which makes it possible to make twelve joints simultaneously. It is understood that this configuration could easily be changed.

The multiple matrix according to FIG. 9 could of course be modified in different ways. Oblong holes with pins or screws like in the embodiment according to FIG. 5 could e.g. be arranged for the implementation of the clamping and guiding functions. In that case the multiple matrix could also be used without separate anvil elements.

An advantageous possibility with the flat matrix designs according to the above is that an apparatus could be implemented by means of which multiple joints could be made simultaneously on work-pieces presenting two or several distinct levels or steps. For this purpose the upper 12" and lower 13" jaws of the apparatus would be provided with at least one step and at least one complementary step respectively, with each complementary step, thus on the lower jaw 13", being provided with a flat matrix 1 having one or several matrix cavities according to any of the embodiments according to the above and each step, i.e. on the upper jaw 12", being provided with corresponding punch element(s) 14".

FIG. 11A shows a top view of a matrix 101 with two elongated matrix elements 102, 103 forming three matrix cavities 123 between them. The matrix cavities 123 are in this figure in the closed position. The matrix elements 102, 103 are in this embodiment arranged for a pivoting movement around a pivoting pin 105 at one end portion of the elongated matrix elements 102, 103. The matrix cavities 123 are typically arranged and grouped in a suitable configuration at the opposite end portion of the matrix elements. The number of matrix cavities could be chosen in relation to the application from one single to several. The two matrix elements are biased against each other by means of spring elements 104 acting on a respective matrix element.

FIG. 11B shows the matrix according to FIG. 11A in open position at the end of the joint forming procedure. The two matrix elements 102, 103 have been displaced in a pivoting movement (arrows C) in relation to each other due to the lateral flow of material during compression of the work pieces against the forces from the spring elements 104.

For positioning the matrix at the start of the joint forming procedure the matrix could be arranged closing the matrix cavities 123 around protruding parts of corresponding anvil elements as described above with reference to FIG. 1. However, this matrix 101 could also be used without separate anvil elements as discussed above with reference to FIG. 5. The matrix 101 could be mounted sliding on a wear plate 134 which could be exchangeable. FIG. 11C shows this arrangement in a perspective view partly in section.

The wear plate 134 will have the function as a common anvil. Due to the arrangement of the matrix cavities 123, with subsequent cavities displaced sideways in relation to each other, pairs or opposite ramps 135, 136 are formed in the two matrix elements. These ramps have been designed to co-operate at the closing of the matrix by means of the forces from the spring elements 104 bringing the matrix elements, and thereby the matrix cavities, to predetermined positions in line with co-operating punch elements 114 at the start of the joint forming procedure.

FIG. 11D shows an arrangement of co-operating punch elements 114 arranged in the same way as shown in FIG. 6.

The invention claimed is:

1. A matrix configured for making clinch-type joints between at least two members of sheet-formed material of the same or different types, metal or non-metal, by means of the matrix and a co-operating punch and an anvil, the matrix comprising a first generally flat sheet-formed matrix element arranged movable relative to a second generally flat sheet-formed matrix element in a same plane so that the first and second matrix elements can slide on an essentially flat support surface between a first initial position in which said first and second matrix elements form between them at least one essentially closed co-axial matrix cavity and a second position corresponding to an open position for said at least one co-axial matrix cavity, said first and second matrix elements being arranged to be actuated in a direction of said first initial position by at least one actuation means, wherein the matrix is configured so that during use the punch is arranged to be driven in an essentially linear movement in the direction of the co-axial matrix cavity, at a bottom of the matrix cavity said anvil is arranged, wherein during forming said clinch-type joints the sheet-formed material of the at least two members is first drawn into the matrix cavity forming a cup-formed protrusion with side walls and a bottom part and then the members are locked to each other by laterally extending said bottom part by means of squeezing the bottom part between the punch and the anvil.

2. The matrix according to claim 1, wherein said first and second matrix elements in said first position form between them a plurality of matrix cavities simultaneously closing and opening at the movement of the matrix elements.

3. The matrix according to claim 1, wherein said actuation means is a resilient actuation means.

4. The matrix according to claim 3, wherein said resilient actuation means comprises at least one spring element.

5. The matrix according to claim 2, wherein said plurality of matrix cavities are arranged on said matrix in a meander-formed configuration with adjacent cavities laterally displaced in relation to each other.

6. The matrix according to claim 1, wherein the first matrix element comprises a frame with two parallel opposite first parts which the frame encloses the second matrix element provided with two parallel opposite second parts or edges in contact with said first parts and being arranged in such a way that the second matrix element will be guided in movement relative to the first matrix element by means of interaction between said first parts and said second parts.

7. The matrix according to claim 2, wherein the plurality of matrix cavities in said first initial position, have an essentially closed contour of circular, or oval.

8. The matrix according to claim 2, wherein the plurality of matrix cavities in said first initial position, have the same size and form.

9. An apparatus for making clinch-type joints between at least two members of sheet-formed material of the same or different types, metal or non-metal, comprising a first and a second tool-carrying member each carrying a separate tool-part, the first tool-carrying member carrying a first tool-part with the punch element and the second tool-carrying member carrying a second tool-part provided with the matrix according to claim 1 and the anvil which co-operate for producing said joint, said punch element of said first tool-part being arranged to be driven in the essentially linear movement in the direction of the co-axial matrix cavity of said second tool-part at the bottom of which said anvil is arranged.

10. The apparatus according to claim 9, wherein said first and second matrix elements are arranged on the essentially flat support surface on said second tool-carrying member independently movable relative to said support surface and essentially in a translational movement relative to each other along an axis A-B in two opposite directions.

11. The apparatus according to claim 9, wherein said first and second matrix elements are arranged on the essentially flat support surface on said second tool-carrying member independently movable relative to said support surface and essentially in a pivotal movement relative to each other in two opposite directions.

12. The apparatus according to claim 10, wherein the first and second matrix elements are arranged for blocked vertical movement of the first and second elements by means of a clamping element.

13. The apparatus according to claim 12, wherein the clamping element comprises an element bridging the first and second matrix elements giving enough freedom for a reciprocating movement of the first and second matrix elements to slide on the support surface and being fixed to the support surface.

14. The apparatus according to claim 12, wherein the clamping element comprises two side-clamping elements arranged along two opposite parallel sides of the first and second matrix element allowing enough freedom for a reciprocating movement of the first and second matrix elements to slide on the support surface in the direction parallel to said opposite sides.

15. The apparatus according to claim 10, wherein said support surface is provided with at least one protruding part of a corresponding anvil element and for positioning the matrix at the start of the joint forming procedure the first and second matrix elements are arranged closing at least one matrix cavity around said at least one protruding part.

16. The matrix according to claim 1, wherein the first and second matrix elements each have an associated flat element surface configured to slide on the essentially flat support surface.

17. A method for making clinch-type joints between at least two members of sheet-formed material of the same or different types, metal or non-metal using the matrix of claim 1, the method comprising:

drawing the sheet-formed material of the at least two members into the least one matrix cavity forming the cup-formed protrusion with the side walls and the bottom part; and locking the members together by laterally extending said bottom part by means of squeezing the bottom part between the punch and the anvil, wherein said matrix is moved between a first initial position in which the first and second matrix elements form between them the least one essentially closed matrix cavity and a second position corresponding to an open position for the least one matrix cavity.

18. A method for making clinch-type joints between at least two members of sheet-formed material of the same or different types, metal or non-metal using the matrix of claim 2, the method comprising:

drawing the sheet-formed material of the at least two members into the plurality of matrix cavities forming a plurality of cup-formed protrusions, each said cup-formed protrusions having the side walls and the bottom part; and locking the members together by laterally extending the bottom part of each cup-formed protrusion by means of squeezing the bottom part between the punch and the anvil, wherein said matrix is moved between a first initial position in which the first and second matrix elements form between them a plurality of essentially closed matrix cavities and a second position corresponding to an open position for the plurality of matrix cavities.

* * * * *